United States Patent [19]

Gerrish

[11] 3,984,086

[45] Oct. 5, 1976

[54] ELECTRO VISCOUS VIBRATORS

[75] Inventor: Arthur Gerrish, Burgess Hill, England

[73] Assignee: Laser Engineering (Development) Limited, London, England

[22] Filed: Aug. 20, 1974

[21] Appl. No.: 499,083

[30] Foreign Application Priority Data

Sept. 25, 1973 United Kingdom ..... 44861/73

[52] U.S. Cl. ..... 259/1 R; 251/129; 259/DIG. 41; 259/DIG. 43

[51] Int. Cl.[2] ..... B01F 11/00; B06B 1/18

[58] Field of Search ..... 259/DIG. 41, DIG. 43, 259/DIG. 44, 1 R, 4 R; 251/129; 310/8

[56] References Cited

UNITED STATES PATENTS

| | | | |
|---|---|---|---|
| 2,902,251 | 9/1959 | Oncley | 251/129 |
| 3,289,017 | 11/1966 | Klass et al. | 310/8 X |
| 3,304,446 | 2/1967 | Martinek et al. | 310/8 |
| 3,465,732 | 9/1969 | Kattchee | 251/129 X |
| 3,524,474 | 8/1970 | McCormick | 251/129 X |
| 3,614,486 | 10/1971 | Smiley | 251/129 X |

*Primary Examiner*—Philip R. Coe
*Attorney, Agent, or Firm*—Holman & Stern

[57] ABSTRACT

An electro viscous vibrator comprises a double-headed dumb-bell shaped piston, of which the two heads are each axially movable within a separate cylindrical chamber, and a pair of concentric annular electroviscous valves in each chamber surrounding the piston head contained therein. Each pair of valves is preferably constituted by an annular electrode assembly disposed between the wall of the respective chamber, and the associated piston head, each valve of the pair being constituted by one of the two annular gaps thus formed between the chamber wall and the electrode assembly and between the electrode assembly and the piston head, suitable electrodes being located on the electrode assembly. The chamber wall and the piston head are preferably earthed, so that when an axial flow of electroviscous fluid is passed through each valve and an electrical voltage is applied alternately across a selected one of the valves of each pair simultaneously and then across the other valve of each pair simultaneously, an axial reciprocatory motion is imposed on the piston.

7 Claims, 2 Drawing Figures

ELECTRO VISCOUS VIBRATORS

This invention relates to electro viscous vibrators.

It is well known that a vibratory force can be produced by subjecting a flow of electro viscous fluid to an electric field and varying the voltage applied. This produces a corresponding variation in the apparent viscosity of the fluid and hence a variation in the pressure developed in the fluid in the direction of flow. It can be shown that the pressure developed due to electro viscosity is substantially proportional to the applied voltage and largely independent of the rate of flow of fluid. Therefore it is not truly a viscosity which is produced but an ability of the fluid to withstand shear forces independent of the shearing rate, which is a characteristic of solids. This principle can be advantageously used in the field of high frequency hydraulic control, and high frequency hydraulic vibrators for use in environmental testing, for example.

According to the present invention, there is provided an electro viscous vibrator comprising a casing having two cylindrical chambers separated by a wall; a double-acting double-headed piston positioned with one of its heads in each chamber, the two heads being spaced by a connecting member which slidingly extends through a close-fitting bore in the wall such that each of the heads is axially moveable within the respective chamber; a pair of annular electro viscous valves located concentrically one inside the other within each chamber so as to surround the piston head located therein; means for providing a flow of electro viscous fluid in an axial direction through the valves of each pair; means for applying an electrical voltage alternately across a selected one of the valves of each pair simultaneously and then across the other valve of each pair simultaneously such that an axial reciprocatory motion is imposed on the piston.

Preferably the means for providing a flow of electro viscous fluid comprises passageways within the casing connected to one end of the outer valve of each pair, further passageways through the piston connected to the same end of the inner valve of each pair, and a source of electro viscous fluid connected to an inlet end of the passageways in the casing. In a preferred embodiment of the invention, the passageways in the casing are arranged such that fluid from the source can be supplied to said one end of the outer valve of each pair, and in which the valves of each pair are arranged such that fluid leaving the said outer valve is passed through the inner valve of the same pair and into said further passageways in the piston from which the fluid is passed out of the vibrator. The said further passageways in the piston may be in fluid connection with second passageways in the casing through which the fluid is passed out of the vibrator.

Each pair of valves is preferably formed by an annular electrode assembly disposed between the wall of the respective chamber and the piston head located therein, there being an annular gap between the chamber wall and the electrode assembly and between the piston head and the electrode assembly, each annular gap constituting one of the valves of the pair when electrodes are attached to the electrode assembly, the casing and the piston. Preferably, the casing and the piston are earthed. In a preferred embodiment of the invention, the said electrodes are attached to the electrode assemblies, the casing and the pistion such that an electrical voltage can be applied simultaneously to the outer valve of one pair and the inner valve of the other pair, the means for providing a flow of electro viscous fluid being arranged such that the direction of fluid flow in the outer valve of said one pair is the same as that in the inner valve of said other pair.

Reference will hereinafter be made to the accompanying drawings, which illustrate one embodiment of the invention, and of which:

Figure 1:
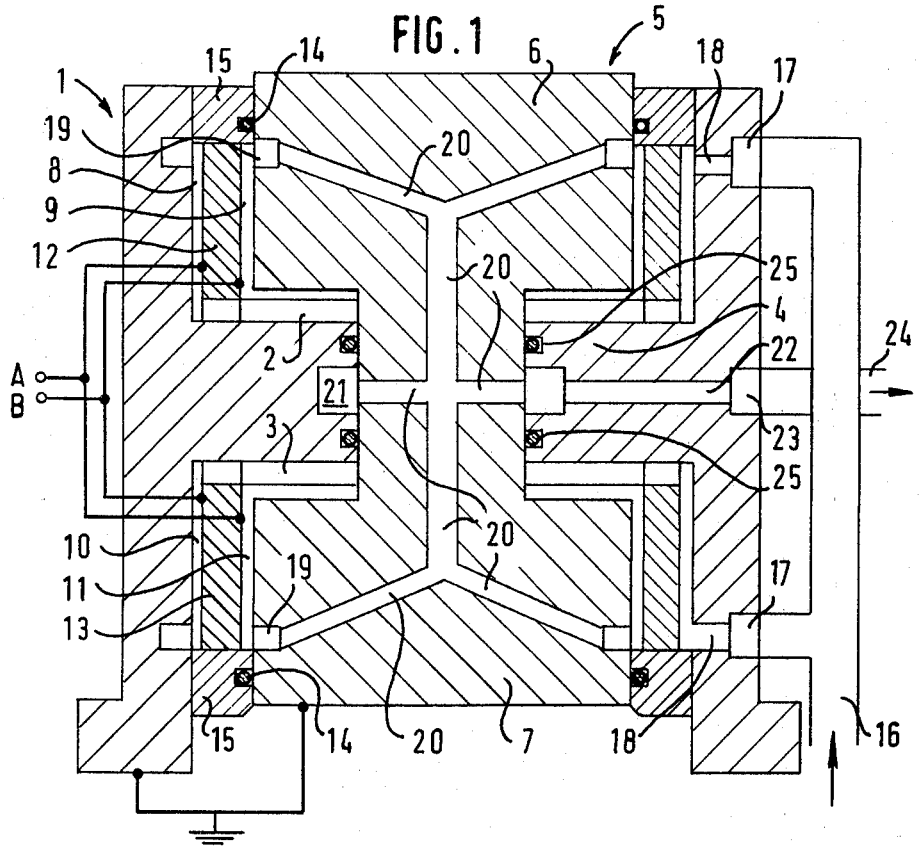
FIG. 1 shows a cross-sectional view of an electro viscous vibrator.

In FIG. 1, a generally cylindrical casing 1 comprises two chambers 2 and 3 which are dumb-bell shaped separated by a dividing wall 4. A dumb-bell shaped piston 5 is arranged in the casing with each of its heads 6 and 7 located in a respective one of the chambers 2 and 3. The relatively short piston rod which connected the heads 6 and 7 extends through a close fitting bore in the wall 4.

Two pairs of annular electro valves 8, 9 and 10, 11 are provided around the piston 5, valves 8 and 9 being arranged around head 6 in chamber 2, valves 10 and 11 around head 7 in chamber 3. The valves of each pair are concentric and arranged one inside the other and are formed by positioning a respective electrode assembly 12 or 13 inside each of the chambers, around the head of the piston within the chamber. Annular gaps are thus provided between each of the electrode assemblies and the wall of the respective chamber to form valves 8 or 10 respectively and between each electrode assembly and the respective piston head to form valves 9 or 11 respectively. High voltage electrodes are located on the inner and outer surfaces of each assembly which, in conjunction with the earthing of both the casing 1 and piston 5, can provide an electric fluid across each valve 8 to 11. Seals 14 are provided in sleeve bearings 15 to prevent fluid leakage and to isolate the sleeve bearings from fluid.

Electro viscous fluid is pumped through line 16 and into entry ports 17 in the casing. The ports 17 each communicate with an annular groove 18 on the inner surface of the casing within each chamber and thus fluid is conducted to the valves 8 and 10 via chambers 2 and 3 to valves 9 and 11. In each valve, the fluid is subjected to an electric field as hereinafter described. The fluid is then exhausted from the valves via annular grooves 19 in each head of the piston, and internal passageways 20 in the piston to an annular groove 21 in the inner surface of the bore of the dividing wall 4, from where it is passed to passage 22 in the casing and finally to exit port 23 and exhaust line 24. Further seals 25 prevent any leakage of fluid from either chamber 2 or 3 through the bore in the dividing wall 4.

Figure 2:
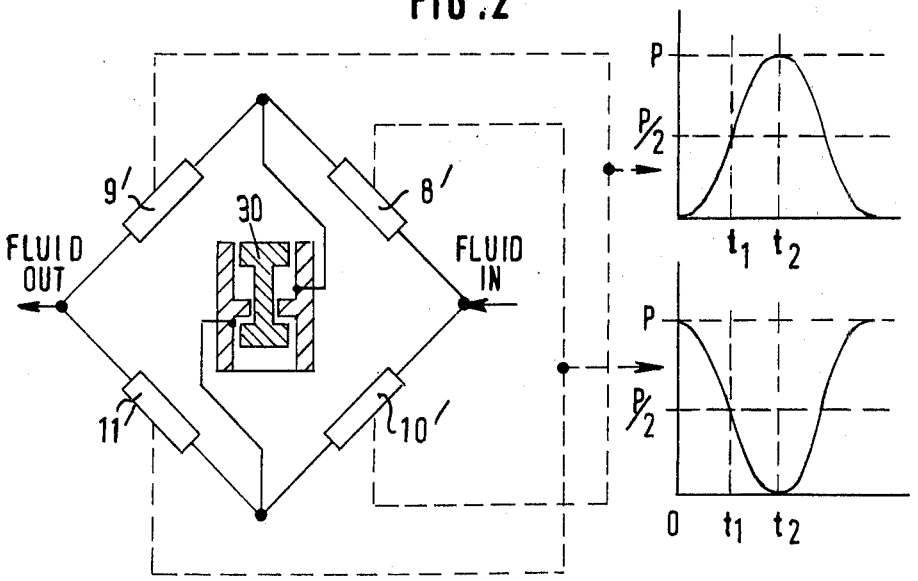
FIG. 2 is a diagrammatic representation of the operation of the vibrator of FIG. 1.

The high voltage electrodes on the electrode assemblies 12 and 13 are interconnected so that valves 8 and 11 operate together to produce a pressure pulse on the piston resulting in a first stroke, and valves 9 and 10 operate to produce a second pressure pulse on the piston which results in the next stroke, when an alternating voltage is applied to each pair of electrodes via terminals A and B. The operation of the vibrator described above is shown diagrammatically in FIG. 2 as being analogous to a Wheatstone Bridge arrangement. In FIG. 2, elements 8′, 9′, 10′ and 11′ represent valves 8, 9, 10 and 11 respectively. The fluid is supplied first to elements 8′ and 10′, as in the vibrator of FIG. 1 and then to elements 9' and 11' before passing out of the system. The resultant effect produced on a double acting piston 30 arranged across the bridge as shown is a series of alternating differential pressure pulses producing vibrating motion of the piston 30. It can be seen from the graphical representation, which shows pressure P produced by each co-operating pair of elements as a function of time $t$ that the elements 8' and 11' together produce a maximum positive pressure when the elements 9' and 10' produce a minimum, and vice versa, resulting in the oscillating motion of the piston 30.

At time 0 the pressure across valves 8 and 11 is at a maximum and across valves 9 and 10 at a minimum. In this condition the piston will be at the top of its travel (as seen in FIG. 2), the differential pressure across the piston at a maximum and the acceleration of the piston also at a maximum P (in a downwards direction). At time $t_1$ the pressure across each valve is P/2, there is no differential pressure across the piston and the piston is in the centre position travelling at maximum velocity (downwards). At time $t_2$ the piston is at the bottom of its travel (i.e. at zero velocity) with maximum pressure P (and hence acceleration) operating upwards.

The vibrator, described in the above preferred embodiment of the invention, has the advantage that there is no need for the provision of external piping between each valve and the piston which due to fluid compressibility effects, tends to impair high frequency performance of the vibrator. The vibrator has a compact valve construction which is relatively easy to assemble without impairing the overall stiffness of the vibrator.

A vibrator according to the invention, where the payload is mounted on the piston heads enabling the piston rod to be relatively short, therefore provides an extremely stiff assembly. In previously known electro viscous vibrators having a piston rod which is encircled by four electro viscous valves which are spaced out along its length, the piston rod is relatively long, which tends to lower the longitudinal stiffness of the assembly and leads to attenuation of the response of the vibrator at the high frequency end of the scale over which it is used. The high stiffness of the dumb-bell shaped piston of the present invention results in an improvement in the high frequency performance of the vibrator at frequencies of, for example, over 2000 Hz.

I claim:

1. An electro viscous vibrator comprising:

a casing having two cylindrical chambers separated by a wall;

a double-acting double-headed piston positioned with one of its heads in each chamber, the two heads being spaced by a connecting member which slidingly extends through a close-fitting bore in the wall such that each of the heads is axially movable within the respective chamber;

two pairs of annular electro viscous valves, the valves of each pair being located concentrically one inside the other within a respective one of the chambers so as to surround the piston head located therein;

means for providing a flow of electro viscous fluid in an axial direction through the valves of each pair;

means for applying an electrical voltage alternately across a selected one of the valves of each pair simultaneously and then across the other valve of each pair simultaneously such that an axial reciprocatory motion is imposed on the piston.

2. An electro viscous vibrator as claimed in claim 1, in which the means for providing a flow of electro viscous fluid comprises passageways within the casing connected to one end of the outer valve of each pair, further passageways through the piston connected to the same end of the inner valve of each pair, and a source of electro viscous fluid connected to an inlet end of the passageways in the casing.

3. An electro viscous vibrator as claimed in claim 2, in which the passageways in the casing are arranged such that fluid from the source can be supplied to said one end of the outer valve of each pair, and in which the valves of each pair are arranged such that fluid leaving the said outer valve is passed through the inner valve of the same pair and into said further passageways in the piston from which the fluid is passed out of the vibrator.

4. An electro viscous vibrator as claimed in claim 3, in which the said further passageways in the piston are in fluid connection with second passageways in the casing through which the fluid is passed out of the vibrator.

5. An electro viscous vibrator as claimed in claim 1, in which each pair of valves is formed by an annular electrode assembly disposed between the wall of the respective chamber and the piston head located therein, there being an annular gap between the chamber wall and the electrode assembly and between the piston head and the electrode assembly, each annular gap constituting one of the valves of the pair when electrodes are attached to the electrode assembly, the casing and the piston.

6. An electro viscous vibrator as claimed in claim 5, in which the casing and the piston are earthed.

7. An electro viscous vibrator as claimed in claim 5, in which the said electrodes are attached to the electrode assemblies, the casing and the piston such that an electrical voltage can be applied simultaneously to the outer valve of one pair and the inner valve of the other pair, the means for providing a flow of electro viscous fluid being arranged such that the direction of fluid flow in the outer valve of said one pair is the same as that in the inner valve of said other pair.

* * * * *